US010891864B2

(12) United States Patent
Kim et al.

(10) Patent No.: US 10,891,864 B2
(45) Date of Patent: Jan. 12, 2021

(54) OBSTACLE WARNING METHOD FOR VEHICLE

(71) Applicant: LG Electronics Inc., Seoul (KR)

(72) Inventors: So-Young Kim, Seoul (KR); Jung Yong Lee, Seoul (KR); Sangkyeong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/554,743

(22) Filed: Aug. 29, 2019

(65) Prior Publication Data

US 2019/0385457 A1 Dec. 19, 2019

(30) Foreign Application Priority Data

Aug. 7, 2019 (KR) ..... 10-2019-0096375

(51) Int. Cl.
*G08G 1/16* (2006.01)
*G08G 1/01* (2006.01)

(52) U.S. Cl.
CPC ..... *G08G 1/163* (2013.01); *G08G 1/0125* (2013.01); *G08G 1/166* (2013.01); *G08G 1/167* (2013.01)

(58) Field of Classification Search
CPC ..... G08G 1/163; G08G 1/167; G08G 1/166; G08G 1/0125; G08G 1/04; G05D 1/0219; G06K 9/00825; G06K 9/00791; B60Q 1/38; B60Q 9/008; B60K 31/0008
See application file for complete search history.

(56) References Cited

U.S. PATENT DOCUMENTS 10,635,915 B1 * 4/2020 Kim ..... G06N 3/084
2009/0252380 A1 * 10/2009 Shimizu ..... G08G 1/163 382/107
2011/0102195 A1 * 5/2011 Kushi ..... G08G 1/166 340/905
2012/0239294 A1 * 9/2012 Stahlin ..... G08G 1/161 701/484
2013/0039644 A1 * 2/2013 Taniguchi ..... H04J 14/0227 398/10
2014/0035738 A1 * 2/2014 Kim ..... B60W 30/12 340/435
2014/0062724 A1 * 3/2014 Varoglu ..... G01S 5/0252 340/902
2015/0183430 A1 * 7/2015 Schwindt ..... B60W 30/09 701/23
2015/0269843 A1 * 9/2015 Ichinokawa ..... G08G 1/167 340/435

(Continued)

*Primary Examiner* — An T Nguyen
(74) *Attorney, Agent, or Firm* — Fish & Richardson P.C.

(57) ABSTRACT

Disclosed herein is an obstacle warning method for a vehicle, which includes detecting a first obstacle through a laser sensor, identifying a location of an adjacent vehicle, determining a blind spot of the adjacent vehicle due to the first obstacle based on the location of the adjacent vehicle, detecting a second obstacle involved in the blind spot through the laser sensor, and transmitting a danger message to the adjacent vehicle. A vehicle to which the disclosure is applied may be connected to any artificial intelligence (AI) module, a drone, an unmanned aerial vehicle, a robot, an augmented reality (AR) module, a virtual reality (VR) module, a $5^{th}$ generation (5G) mobile communication device, and so on.

21 Claims, 20 Drawing Sheets

(56) References Cited

U.S. PATENT DOCUMENTS

| | | | | |
|---|---|---|---|---|
| 2017/0174262 | A1* | 6/2017 | Kobayashi | G01S 19/14 |
| 2017/0291545 | A1* | 10/2017 | Lai | G08G 1/166 |
| 2017/0355263 | A1* | 12/2017 | Banvait | B60R 1/00 |
| 2017/0357859 | A1* | 12/2017 | Jain | G06K 9/00791 |
| 2018/0121740 | A1* | 5/2018 | Boss | G06K 9/00805 |
| 2018/0233049 | A1* | 8/2018 | Ishii | G08G 1/04 |
| 2018/0261099 | A1* | 9/2018 | Mohra | G08G 1/167 |
| 2018/0336787 | A1* | 11/2018 | Ohnishi | G08G 1/167 |
| 2018/0362037 | A1* | 12/2018 | Ishiwatari | B60W 30/0956 |
| 2019/0011913 | A1* | 1/2019 | Chu | G01C 21/30 |
| 2019/0088138 | A1* | 3/2019 | Kang | B60W 10/20 |
| 2019/0259283 | A1* | 8/2019 | Sung | B60Q 1/46 |
| 2019/0385457 | A1* | 12/2019 | Kim | G08G 1/166 |
| 2020/0062277 | A1* | 2/2020 | Kim | G01S 13/867 |
| 2020/0086789 | A1* | 3/2020 | Nowakowski | G06T 15/503 |

* cited by examiner

OBSTACLE WARNING METHOD FOR VEHICLE

CROSS-REFERENCE TO RELATED APPLICATION

The present disclosure claims priority to and the benefit of Korean Patent Application No. 10-2019-0096375, filed on Aug. 7, 2019, the disclosure of which is incorporated herein by reference in its entirety.

BACKGROUND

1. Technical Field

The present disclosure relates to a method for warning of an obstacle existing in a blind spot of an adjacent vehicle.

2. Related Art

In recent years, as part of the development of autonomous vehicles, studies on driving technology of the vehicles in consideration of their surroundings are ongoing. For this purpose, various sensors capable of detecting the surroundings are provided in the vehicles.

Most sensors provided in a vehicle identify an object by radially emitting signals and detecting signals reflected back from the object. Accordingly, the vehicle to date is able to identify only an object which the radially emitted signals reach, and has a limitation in that it is not be able to identify an object which the signals do not reach.

Due to such a limitation, the vehicle may not identify a small object that is hidden behind a large object, and an accident may occur when the small object hidden behind the large object suddenly emerges. For example, the vehicle may not identify a small vehicle located immediately behind an oncoming large vehicle in an opposite lane, and an accident may inevitably occur when the small vehicle suddenly emerges.

Therefore, there is a need for a method capable of checking and warning when there is one object that is hidden by another object and not identified by a sensor.

SUMMARY

It is an object of the present invention is to provide an obstacle warning method for a vehicle, which allows an adjacent vehicle to be warned of one obstacle existing in a blind spot due to another obstacle.

It is another object of the present invention is to provide an obstacle warning method for a vehicle, which allows an adjacent vehicle to be warned of an obstacle existing in a blind spot due to a traveling vehicle.

The present invention is not limited to the above-mentioned objects, and other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In order to accomplish the above-mentioned objects, in accordance with an aspect of the present invention, there is provided an obstacle warning method for a vehicle, which include detecting a first obstacle through a laser sensor, identifying a location of an adjacent vehicle, determining a blind spot of the adjacent vehicle due to the first obstacle based on the location of the adjacent vehicle, detecting a second obstacle involved in the blind spot through the laser sensor, and transmitting a danger message to the adjacent vehicle.

In order to accomplish the above-mentioned objects, in accordance with another aspect of the present invention, there is provided an obstacle warning method for a vehicle, which include identifying a location of an adjacent vehicle, generating a bounding box of a traveling vehicle, determining a blind spot of the adjacent vehicle by the bounding box of the traveling vehicle based on the location of the adjacent vehicle, detecting an obstacle involved in the blind spot through a laser sensor, and transmitting a danger message to the adjacent vehicle.

DETAILED DESCRIPTION

Figure 1:
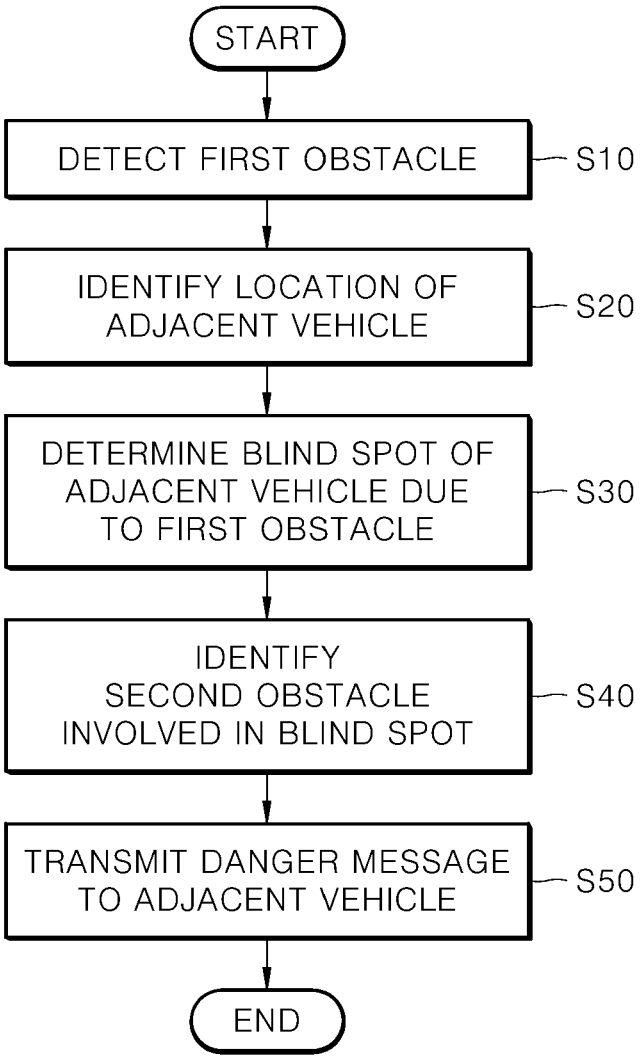
FIG. 1 is a flowchart illustrating an obstacle warning method for a vehicle according to an embodiment of the present invention.

The above objects, features, and advantages will be described in detail with reference to the accompanying drawings, whereby the technical idea of the present invention may be easily implemented by those skilled in the art to which the present invention pertains. In certain embodiments, detailed descriptions of technologies well known in the art may be omitted to avoid obscuring appreciation of the disclosure. Exemplary embodiments of the present invention will be described below in more detail with reference to the accompanying drawings. In the drawings, the same reference numbers will be used to refer to the same or like parts.

The present invention relates to a method for warning of an obstacle existing in a blind spot of an adjacent vehicle.

Hereinafter, an obstacle warning method for a vehicle according to an embodiment of the present invention will be described in detail with reference to FIGS. 1 to 11.

Figure 2:
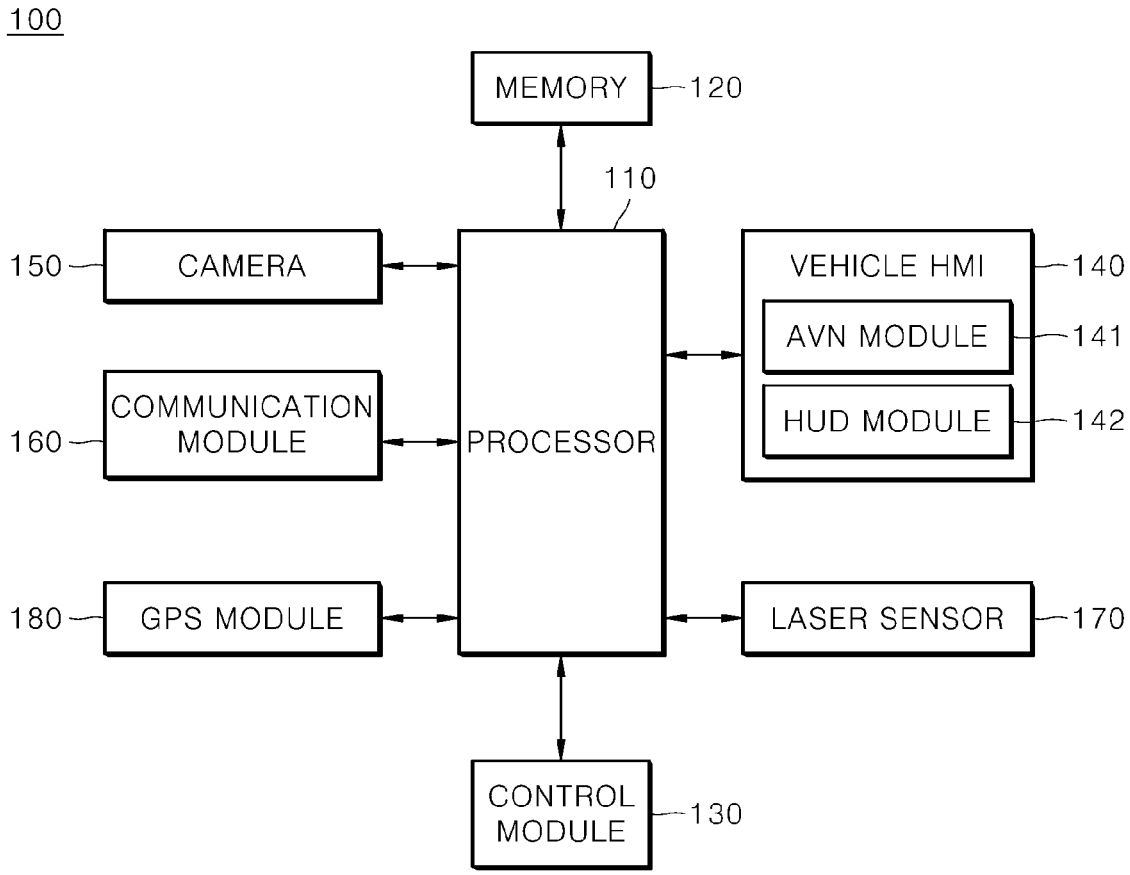
FIG. 2 is a diagram illustrating an internal configuration of a vehicle according to an embodiment of the present invention.

FIG. 1 is a flowchart illustrating an obstacle warning method for a vehicle according to an embodiment of the present invention. FIG. 2 is a diagram illustrating an internal configuration of a vehicle according to an embodiment of the present invention.

Figure 3:
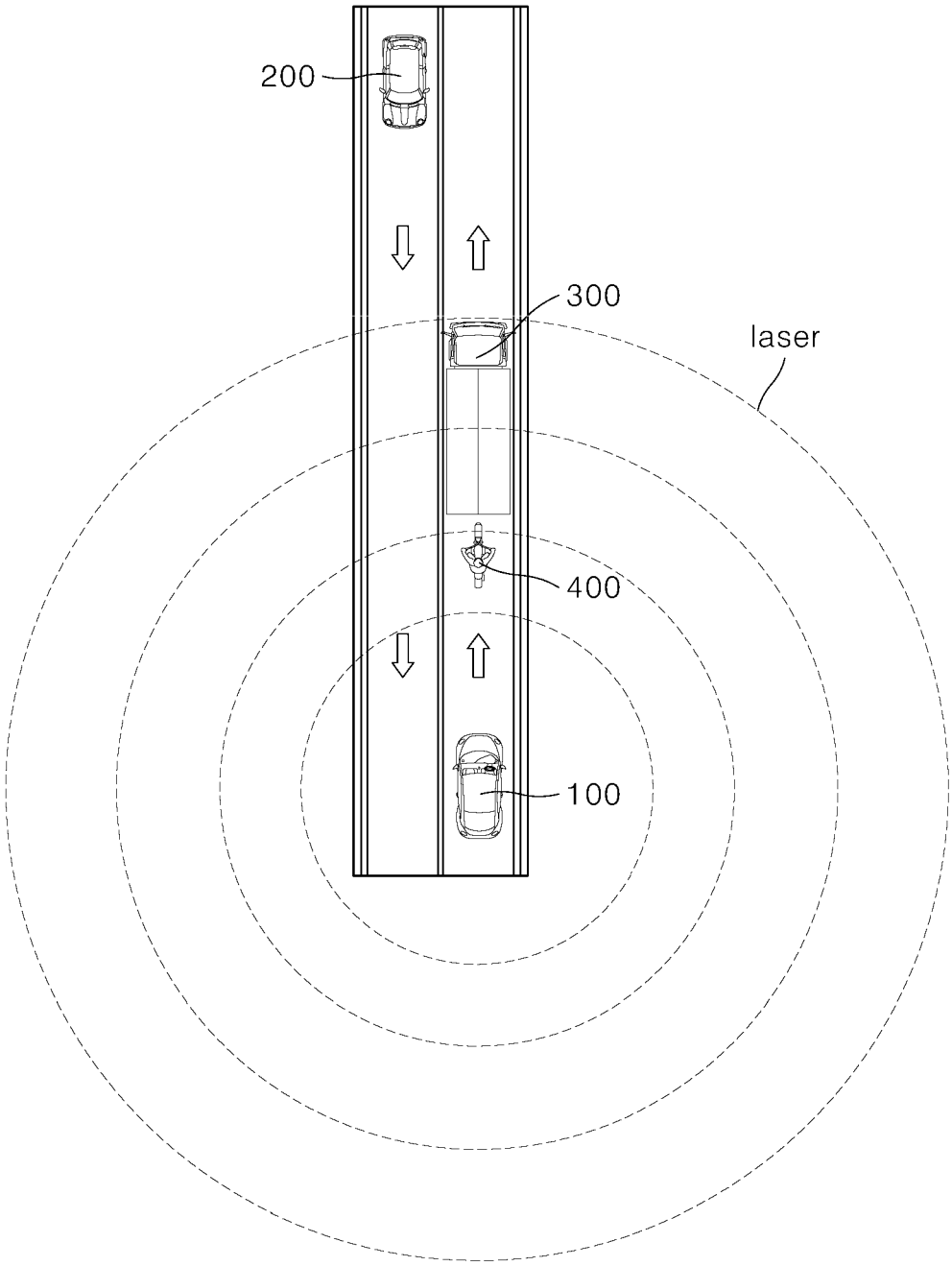
FIG. 3 is a view illustrating a state in which the vehicle detects an obstacle using a laser sensor.

FIG. 3 is a view illustrating a state in which the vehicle detects an obstacle using a laser sensor.

Figure 4A:
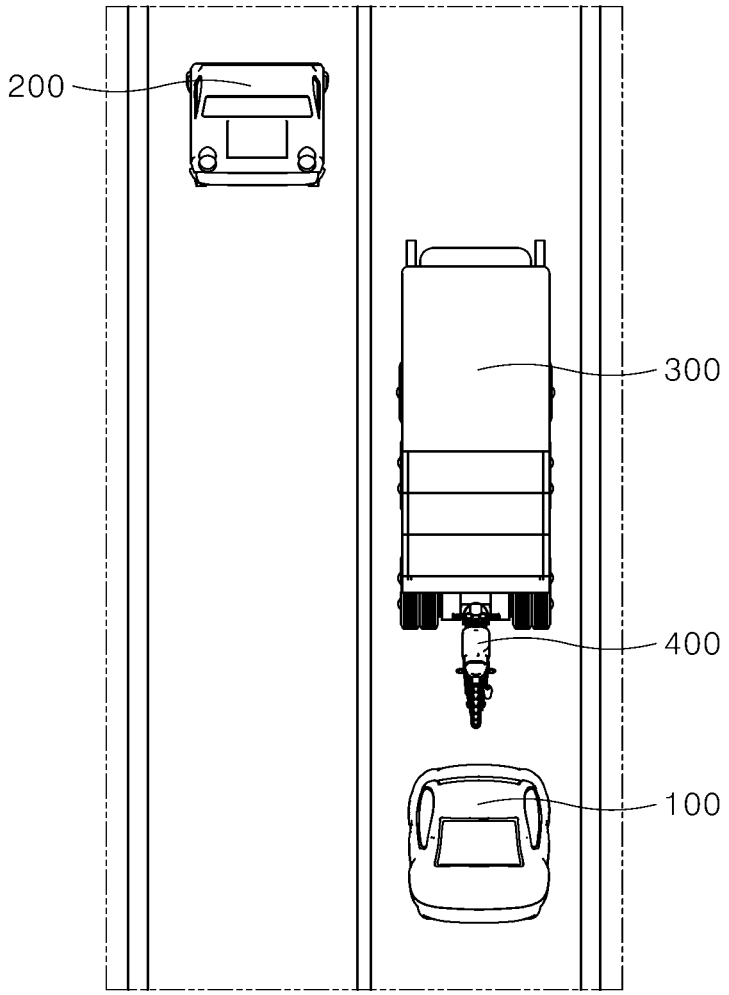
FIGS. 4A and 4B are views illustrating a state in which a second obstacle is located behind a first obstacle, and a state in which a second obstacle is hidden by a first obstacle in the field of view of an adjacent vehicle, respectively.
Figure 4B:
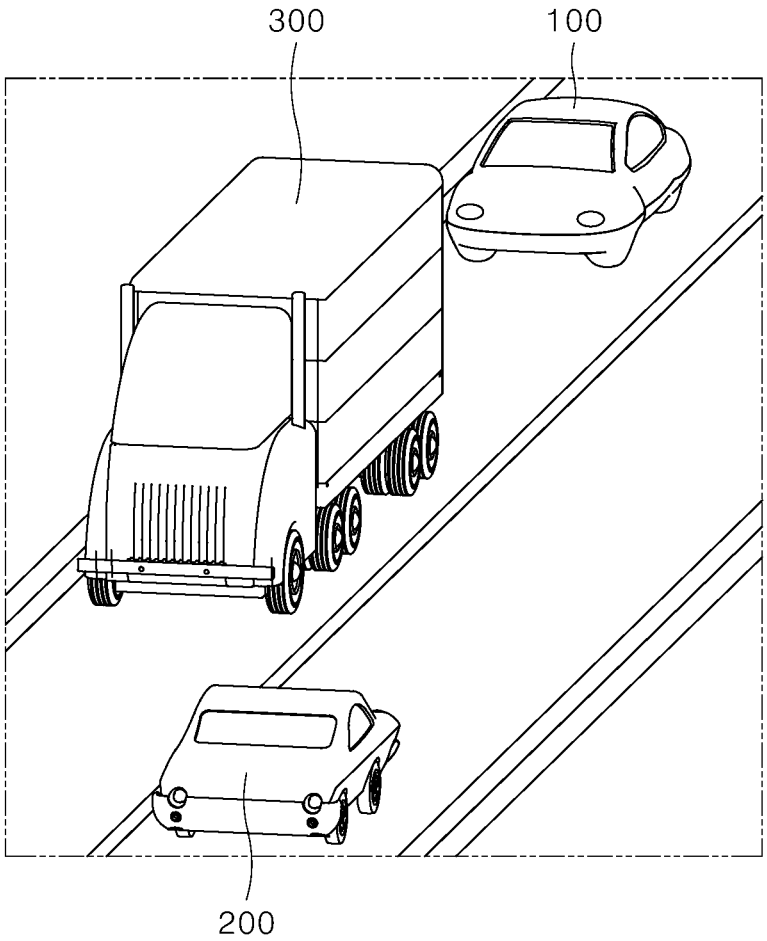

FIGS. 4A and 4B are views illustrating a state in which a second obstacle is located behind a first obstacle, and a state in which a second obstacle is hidden by a first obstacle in the field of view of an adjacent vehicle, respectively.

Figure 5A:
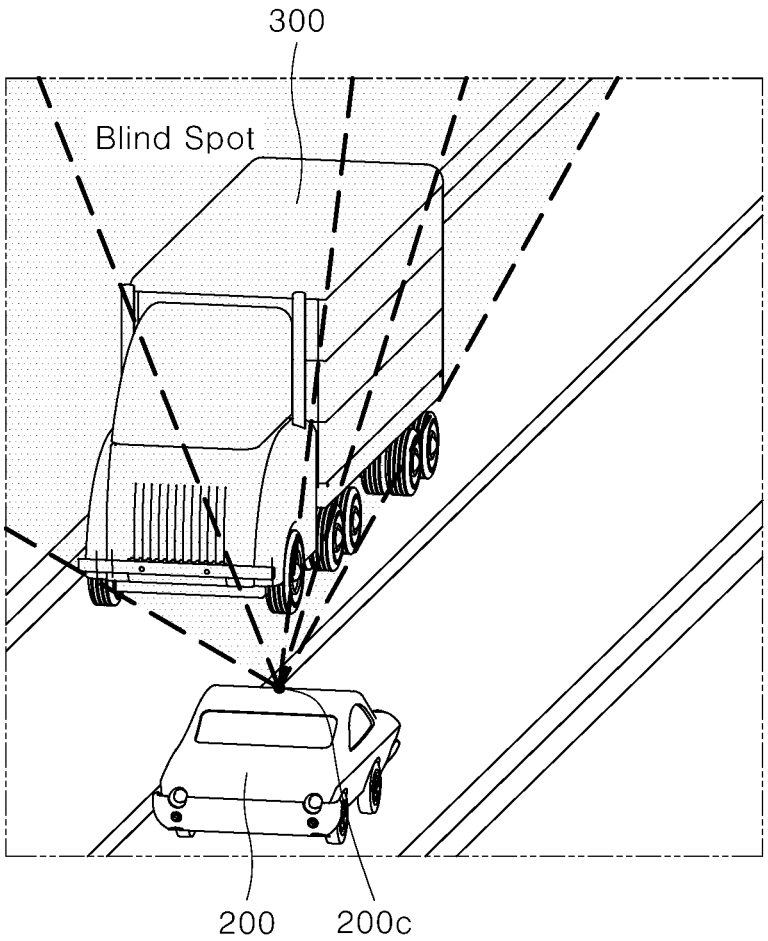
FIGS. 5A and 5B are views for explaining a blind spot caused by a first obstacle.
Figure 5B:
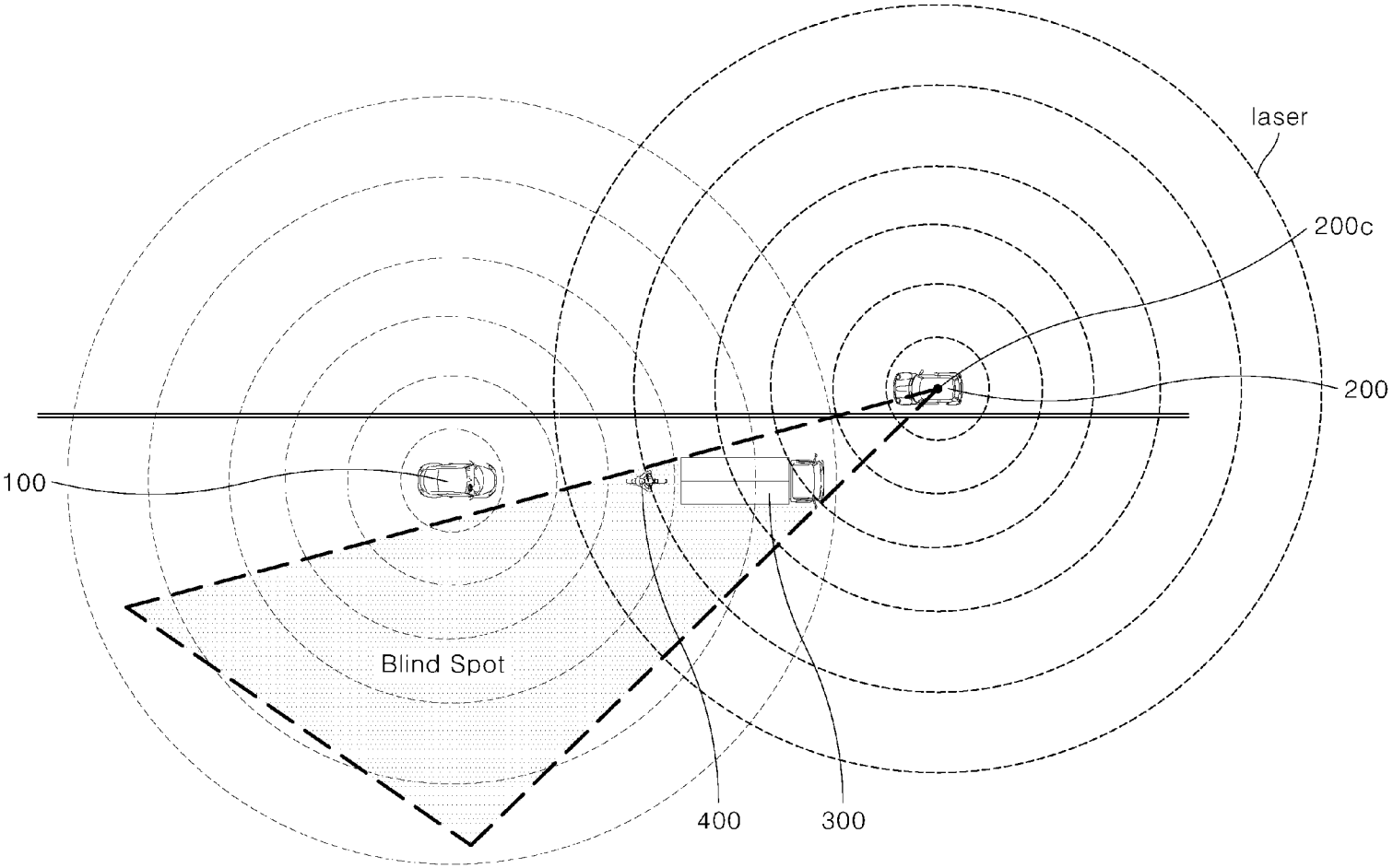

FIGS. 5A and 5B are views for explaining a blind spot caused by a first obstacle.

Figure 6:
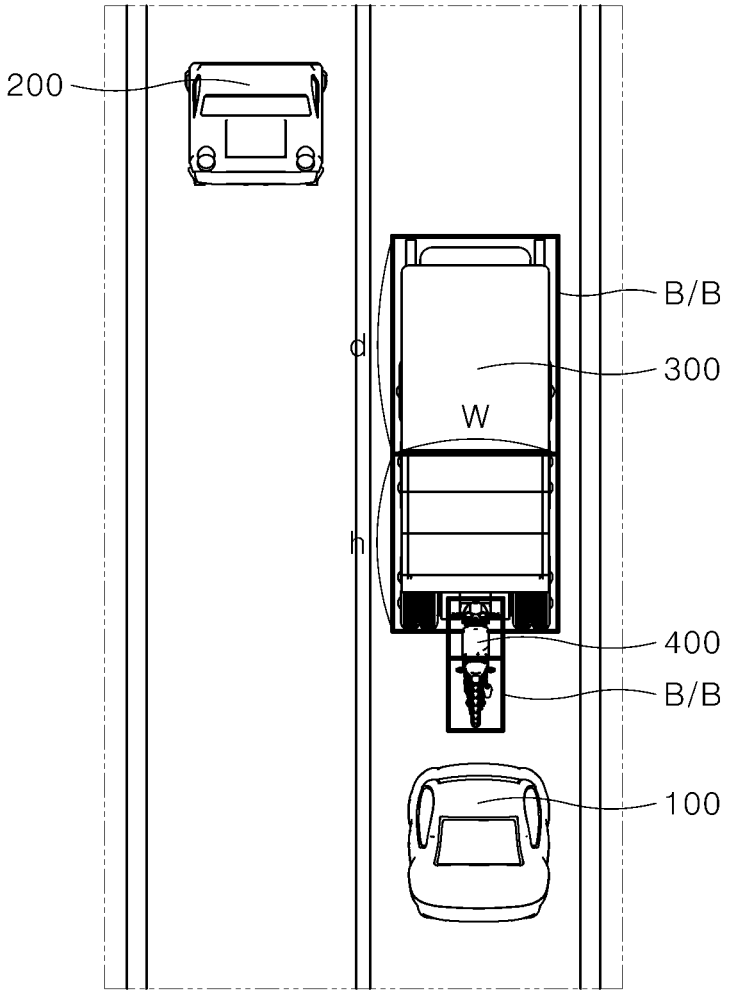
FIG. 6 is a view illustrating a bounding box for each obstacle.

FIG. 6 is a view illustrating a bounding box for each obstacle.

Figure 7:
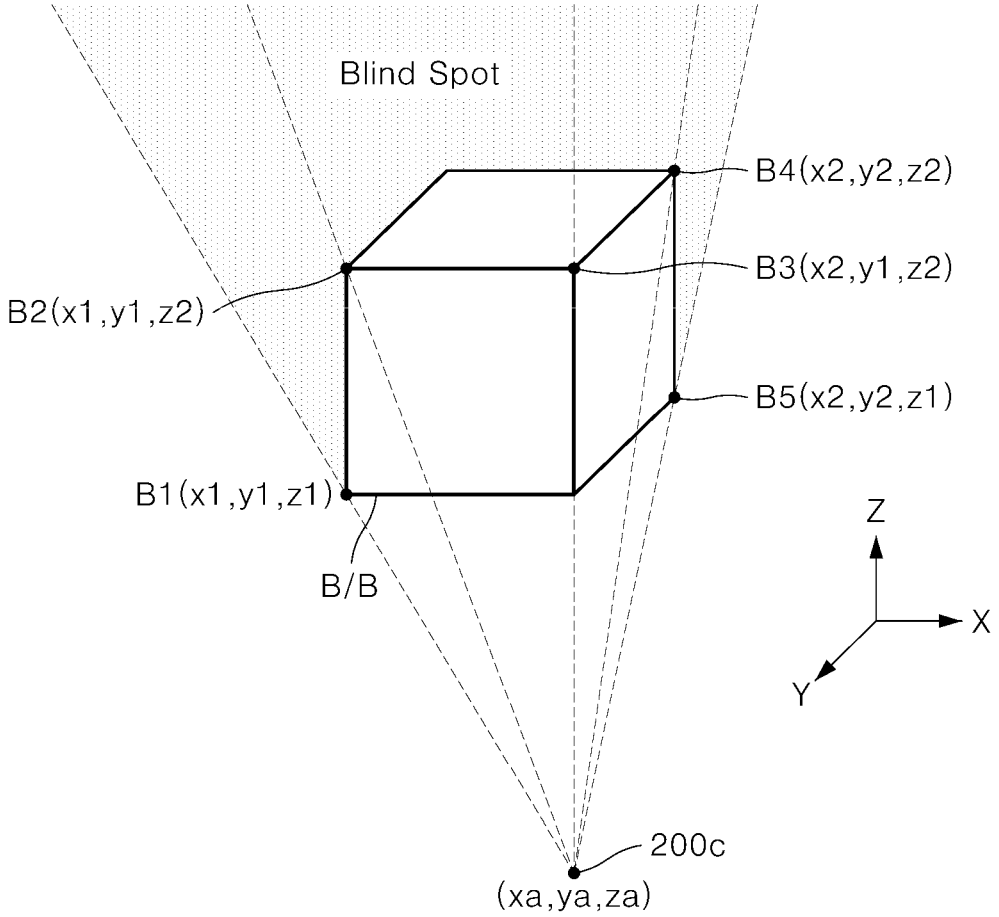
FIG. 7 is a view for explaining a blind spot determined according to location coordinates of an adjacent vehicle and corner coordinates on a bounding box.

FIG. 7 is a view for explaining a blind spot determined according to location coordinates of an adjacent vehicle and corner coordinates on a bounding box.

Figure 8:
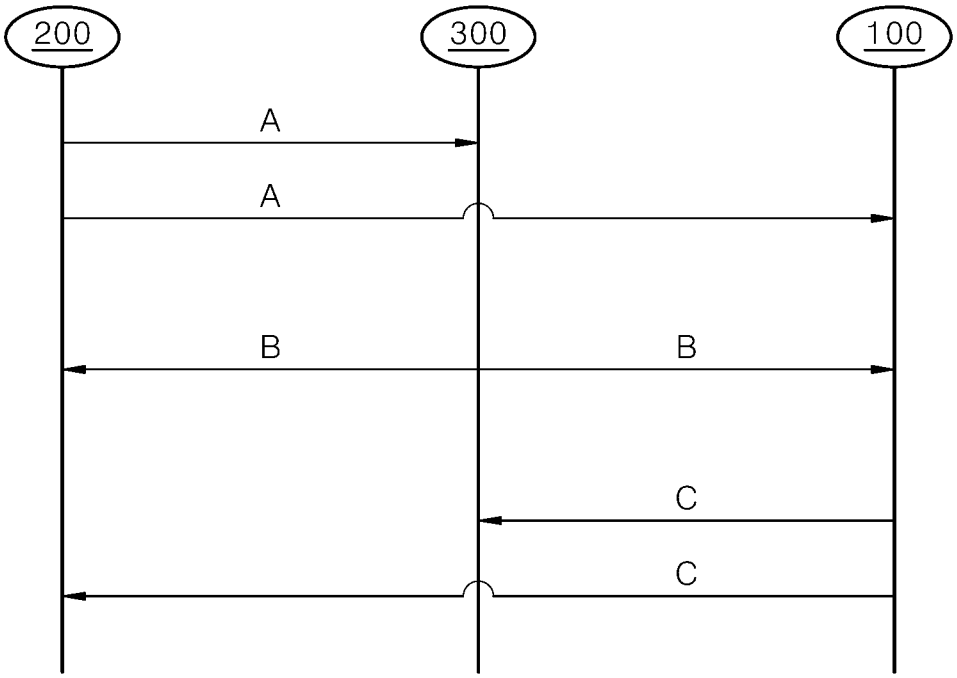
FIG. 8 is a diagram for explaining transmission and reception of messages between a traveling vehicle, an obstacle, and an adjacent vehicle.

FIG. 8 is a diagram for explaining transmission and reception of messages between a traveling vehicle, an obstacle, and an adjacent vehicle.

Figure 9A:
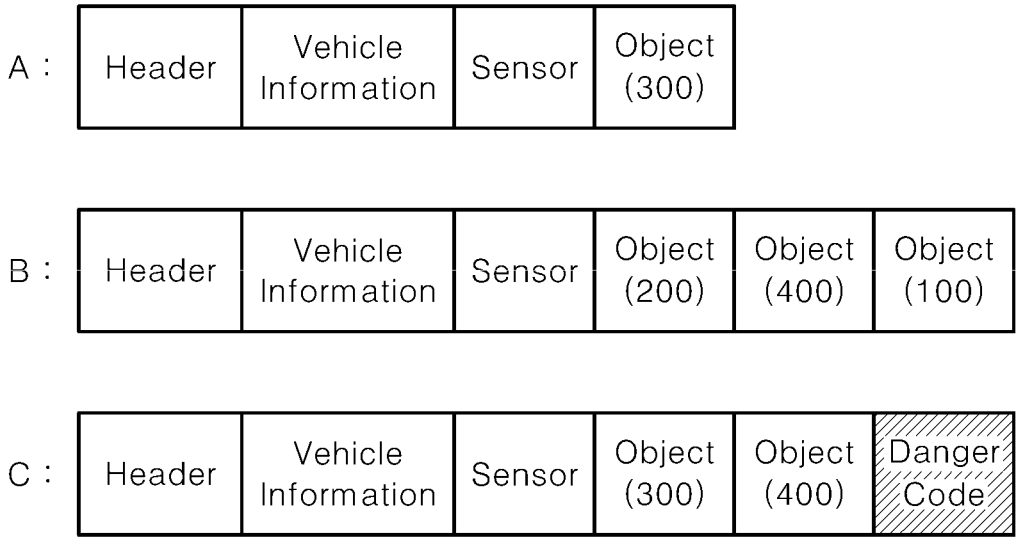
FIGS. 9A and 9B are diagrams illustrating a frame of each message of FIG. 8.
Figure 9B:
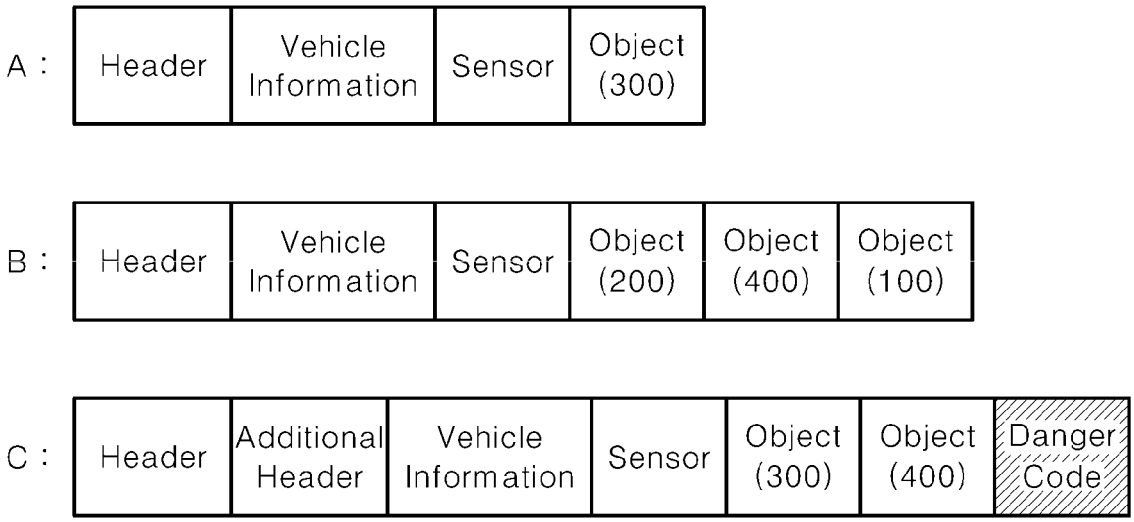

FIGS. 9A and 9B are diagrams illustrating a frame of each message of FIG. 8.

Figure 10:
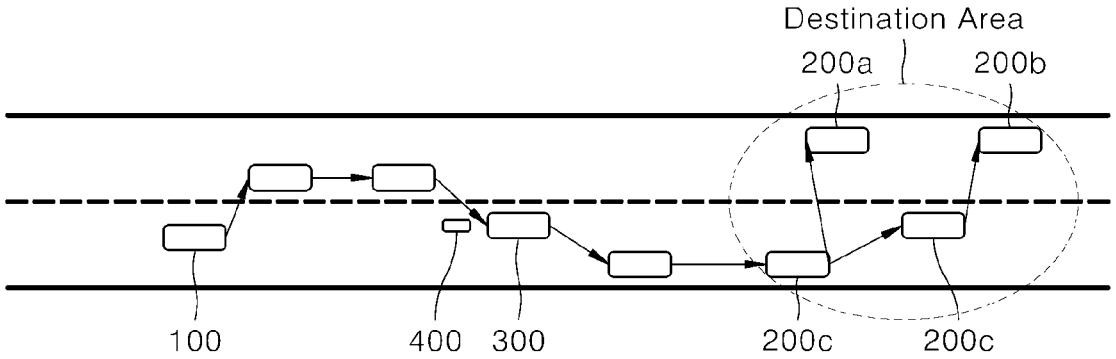
FIG. 10 a diagram for explaining message transmission in a geo-networking manner.

FIG. 10 a diagram for explaining message transmission in a geo-networking manner.

Figure 11:
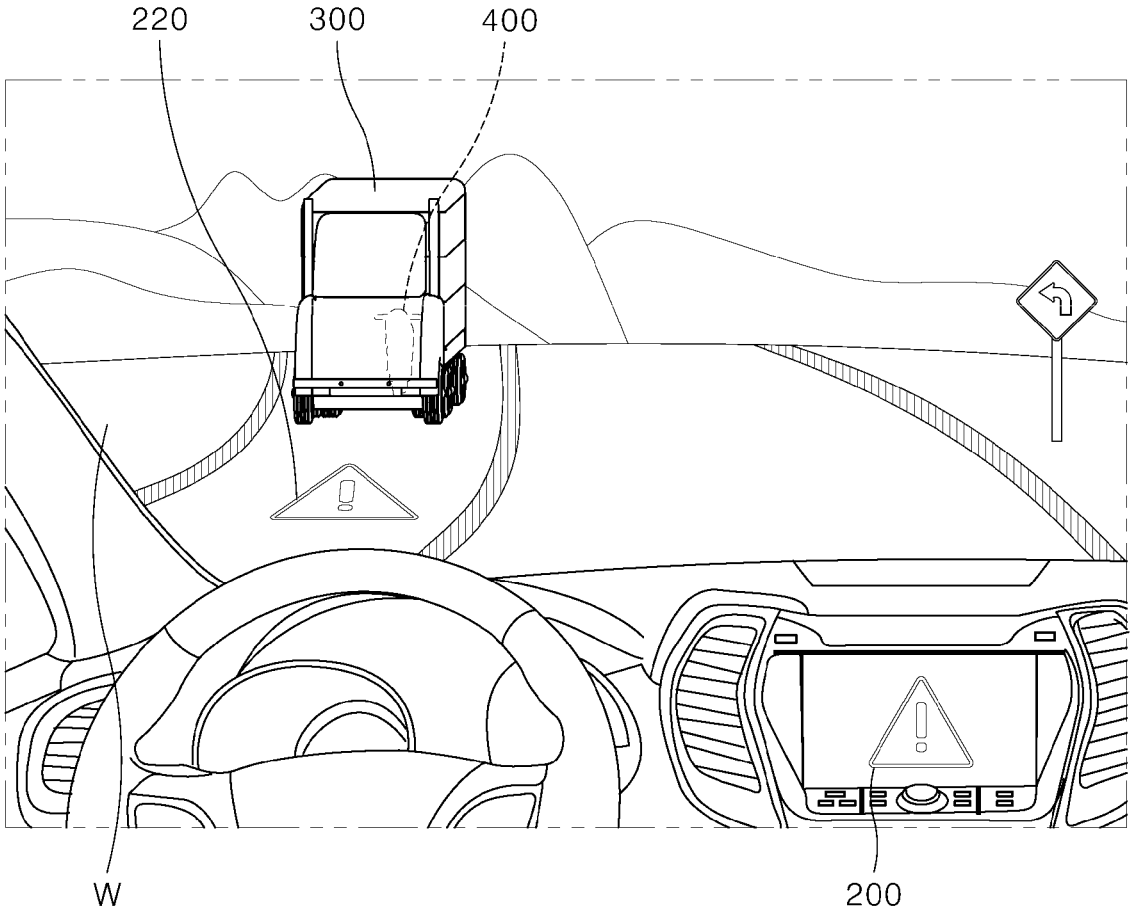
FIG. 11 is a view illustrating a screen output through a vehicle HMI of an adjacent vehicle.

FIG. 11 is a view illustrating a screen output through a vehicle HMI of an adjacent vehicle.

Referring to FIG. 1, the obstacle warning method for a vehicle (hereinafter, referred to as "obstacle warning method") according to the embodiment of the present invention may include a step of detecting a first obstacle (S10), a step of identifying a location of an adjacent vehicle (S20), a step of determining a blind spot of the adjacent vehicle due to the first obstacle (S30), a step of identifying a second obstacle involved in the blind spot (S40), and a step of transmitting a danger message to the adjacent vehicle (S50).

The obstacle warning method illustrated in FIG. 1 is by way of example only so that each step of the invention is not limited to the embodiment illustrated in FIG. 1, and some steps may be added, changed, or deleted as necessary.

The obstacle warning method of the present invention may be performed by a vehicle 100. Examples of the vehicle 100 to be described later may include an internal combustion engine vehicle equipped with an engine as a power source, a hybrid vehicle equipped with an engine and an electric motor as a power source, an electric vehicle equipped with an electric motor as a power source, and a fuel cell electric vehicle equipped with a fuel cell as a power source.

In addition, the vehicle 100 may be an autonomous vehicle capable of operating to a destination by itself without a user's operation. In this case, the autonomous vehicle may be connected to any artificial intelligence (AI) module, a drone, an unmanned aerial vehicle, a robot, an augmented reality (AR) module, a virtual reality (VR) module, a $5^{th}$ generation (5G) mobile communication device, and so on.

Referring to FIG. 2, the vehicle 100 performing the present invention may include a processor 110, a memory 120, a control module 130, a vehicle HMI 140, a camera 150, a communication module 160, a laser sensor 170, and a global positioning system (GPS) module 180. The vehicle 100 illustrated in FIG. 2 is by way of example only for describing the invention so that the components thereof are not limited to the embodiment illustrated in FIG. 2, and some components may be added, changed, or deleted as necessary.

Each component in the vehicle 100 may be implemented by a physical device including at least one of application specific integrated circuits (ASICs), digital signal processors (DSPs), digital signal processing devices (DSPDs), programmable logic devices (PLDs), field programmable gate arrays (FPGAs), controllers, micro-controllers, and microprocessors.

In addition, the operation of each component in the vehicle 100 may be controlled by the processor 110, and the processor 110 may process data acquired from or provided to each component. The memory 120 may include a ROM, a RAM, an EPROM, a flash drive, a hard drive, etc., to store a program for the operation of the processor 110 and various types of data for the overall operation of the vehicle 100.

Hereinafter, the obstacle warning method illustrated in FIG. 1 will be described with reference to each component illustrated in FIG. 2. Meanwhile, the vehicle 100 to be described later may have a concept including all of an obstacle, a traveling vehicle, and an adjacent vehicle, and each of them may perform the obstacle warning method to be described later. However, for convenience of description, the vehicle 100 performing each step of the invention will be described as a traveling vehicle.

The traveling vehicle 100 may detect a first obstacle 300 through the laser sensor 170 (S10).

The laser sensor 170 may emit laser, and when the emitted laser is reflected from the first obstacle 300, the laser sensor 170 may detect the reflected laser. The processor 110 may detect the first obstacle 300 based on the laser detected by the laser sensor 170.

Referring to FIG. 3, the laser sensor 170 in the traveling vehicle 100 may emit laser in a radial shape. To this end, the laser sensor 170 may be rotatably fixed to the outer surface of the traveling vehicle 100. The laser emitted from the laser sensor 170 may be reflected by the first obstacle 300, and the reflected laser may be detected by the laser sensor 170. The processor 110 may detect the first obstacle 300 through the laser detected by the laser sensor 170, and may identify the location and size of the first obstacle 300 based on the incident angle and intensity of the laser, the time of flight (TOF) and phase sift of the laser, or the like.

The laser sensor 170 may be a radio detecting and ranging (RADAR) that emits and detects microwaves as a laser, and may be a light detection and ranging (LiDAR) that emits and detects light (e.g., laser pulses) as a laser. Besides, the laser sensor 170 may be implemented as various sensors for emitting and detecting laser having any wavelength.

When the first obstacle 300 is detected, the traveling vehicle 100 may identify the location of an adjacent vehicle 200 (S20). The adjacent vehicle 200 may be defined as a vehicle within a predetermined distance from the traveling vehicle 100, or may be defined as a vehicle identified through the laser sensor 170 of the traveling vehicle 100.

By way of example, the traveling vehicle 100 may receive location information from the adjacent vehicle 200 to identify the location of the adjacent vehicle 200.

In the present invention, the vehicles may exchange a message with each other through vehicle to vehicle (V2V) communication or vehicle to everything (V2X) communication. Such communication may be performed within a predetermined distance, and the message transmitted and received on a communication network may include location information of a message origination vehicle.

More specifically, the in-vehicle GPS module 180 may acquire its location coordinates by analyzing satellite signals output from a satellite. Since the GPS module 180 is built in the vehicle, the location coordinates acquired by the GPS module 180 may be the location coordinates of the vehicle.

The in-vehicle communication module 160 may include the location coordinates acquired in real time by the GPS module 180 in a message, and transmit the message in a broadcast manner on the communication network. In such a manner, the adjacent vehicle 200 may transmit a message including its location coordinates 200*c*, and the traveling vehicle 100 may receive the message to identify the location of the adjacent vehicle 200.

In another example, the traveling vehicle 100 may identify the location of the adjacent vehicle 200 through the laser sensor 170.

As described above, the traveling vehicle 100 may identify an object therearound through the laser sensor 170. More specifically, the processor 110 may generate a three-dimensional map for the periphery of the traveling vehicle 100 based on the laser detected by the laser sensor 170, and may identify the adjacent vehicle 200 based on the image displayed on the generated map. When the adjacent vehicle 200 is identified, the processor 110 may identify the location of the adjacent vehicle 200 based on the incident angle and intensity of the laser, the time of flight (TOF) and phase sift of the laser, or the like, which are detected by the laser sensor 170.

In still another example, the traveling vehicle 100 may identify the location of the adjacent vehicle 200 through the camera 150.

The in-vehicle camera 150 may capture an external image of the traveling vehicle 100 in real time. The processor 110 may analyze the external image captured by the camera 150 to detect the adjacent vehicle 200 as an object and identify the location and size of the object.

In order to detect the adjacent vehicle 200 as the object, the processor 110 may carry out an object detection operation performed by techniques such as frame differencing, optical flow, and background subtraction, and an object classification operation performed by techniques such as shape-based classification, motion-based classification, color-based classification, and texture-based classification.

In addition, in order to track the adjacent vehicle 200 detected as the object, the processor 110 may carry out an object tracking operation performed by techniques such as point tracking, kernel tracking, and silhouette.

When the location of the adjacent vehicle 200 is identified, the traveling vehicle 100 may determine a blind spot of the adjacent vehicle 200 due to the first obstacle 300 based on the location of the adjacent vehicle 200 (S30).

Here, the blind spot may be defined as an area where the adjacent vehicle 200 does not secure a field of view at its location due to the first obstacle 300. That is, the blind spot may be an area where the field of view of the occupant in the adjacent vehicle 200 is not secured, an area where the angle of view of the camera 150 provided in the adjacent vehicle 200 is not secured, and an area that is not detected by the laser sensor 170 provided in the adjacent vehicle 200.

Referring to FIG. 4A, the first obstacle 300 may be located in front of the traveling vehicle 100, and a small vehicle 400 (e.g., a motorcycle) may be located between the traveling vehicle 100 and the first obstacle 300. In this case, the adjacent vehicle 200 may be traveling in an opposite lane.

Referring to FIG. 4B, the adjacent vehicle 200 may not view the small vehicle 400 at its location due to the first obstacle 300. In other words, the occupant in the adjacent vehicle 200 may not view the small vehicle 400 located behind the first obstacle 300, and the camera 150 and the laser sensor 170 provided in the adjacent vehicle 200 may not identify the small vehicle 400 located behind the first obstacle 300.

Referring to FIGS. 5A and 5B, the blind spot of the adjacent vehicle 200 due to the first obstacle 300 may be determined according to the distance between the location coordinates 200*c* of the adjacent vehicle 200 and the first obstacle 300 and the volume of the first obstacle 300. Accordingly, the traveling vehicle 100 may determine the blind spot according to the location coordinates 200*c* of the adjacent vehicle 200 and the location and volume of the first obstacle 300.

As described above, the traveling vehicle 100 may identify the location and size of the first obstacle 300 using the camera 150 or the radar sensor. To this end, the traveling vehicle 100 may extract a feature point of the first obstacle 300.

The processor 110 may extract a feature point of the first obstacle 300 from the image captured by the camera 150 or the three-dimensional image generated by the laser detected by the radar sensor. For example, when the first obstacle 300 is a truck, the processor 110 may extract the corner or the vertex of the body of the truck as a feature point.

To this end, the processor 110 may use algorithms such as Harris corner, Shi-Tomasi, scale-invariant feature transform (SIFT), speeded up robust features (SURF), features from accelerated segment test (FAST), adaptive and generic corner detection based on the accelerated segment test (AGAST), and fast key point recognition in ten lines of code (FERNS), which are used in the art.

The processor 110 may determine each coordinate of the feature point of the first obstacle 300 based on the descriptor of the feature point, and may determine the blind spot of the adjacent vehicle 200 based on the location coordinates 200*c* of the adjacent vehicle 200 and each coordinate of the feature point. As illustrated in FIGS. 5A and 5B, the processor 110 may determine the blind spot of the adjacent vehicle 200 due to the first obstacle 300 by connecting the location coordinates 200*c* of the adjacent vehicle 200 to the coordinates of each feature point of the first obstacle 300.

In addition, the processor 110 may generate a bounding box (B/B) of the first obstacle 300 to determine the blind spot of the adjacent vehicle 200 based on the location coordinates 200*c* of the adjacent vehicle 200 and the corner coordinates of the bounding box. Here, the bounding box may be defined as a virtual three-dimensional area defining the volume of the first obstacle 300.

More specifically, the processor 110 may generate the bounding box of the first obstacle 300 based on the three-dimensional image of the first obstacle 300 identified by the radar sensor. For example, the processor 110 may identify the first obstacle 300 through point cloud compression utilizing MPEG-I standard technology, and may generate the bounding box including the first obstacle 300.

Referring to FIG. 6, the processor 110 may generate the bounding box of the first obstacle 300 into a rectangular parallelepiped that has a predetermined width w, a predetermined depth d, and a predetermined height h, and includes the first obstacle 300 therein. When the bounding box is generated, the processor 110 may store the coordinates of each corner defining the bounding box in the memory 120.

The processor 110 may determine the blind spot of the adjacent vehicle 200 based on the corner coordinates of the bounding box stored in the memory 120 and the location coordinates 200*c* of the adjacent vehicle 200.

Referring to FIG. 7, the processor 110 may determine the blind spot of the adjacent vehicle 200 due to the first obstacle 300 by connecting the location coordinates 200*c* of the adjacent vehicle 200 to individual corner coordinates B1, B2, B3, B4, and B5 of the bounding box.

Meanwhile, in the operation of generating the bounding box, the processor 110 may adjust the size of the bounding box according to the speed of the adjacent vehicle 200.

The present invention is aimed at warning the adjacent vehicle 200 of a danger to the obstacle existing in the blind spot. However, the faster the speed of the adjacent vehicle 200, the more difficult the defensive driving against the obstacle.

Accordingly, the processor 110 may identify the speed of the adjacent vehicle 200 and adjust the size of the bounding box in proportion to the identified speed of the adjacent vehicle 200.

More specifically, the processor 110 may identify the speed of the adjacent vehicle 200 through the above-mentioned radar sensor, or may calculate the speed of the adjacent vehicle 200 based on the location information received from the adjacent vehicle 200. In addition, when the speed information of the adjacent vehicle 200 is included in the message received from the adjacent vehicle 200, the processor 110 may identify the speed of the adjacent vehicle 200 by referring to the above message.

The processor 110 may increase the size of the bounding box in proportion to the speed of the adjacent vehicle 200. For example, referring to FIG. 6, the bounding box of the first obstacle 300 illustrated in FIG. 6 may be generated based on when the speed of the adjacent vehicle 200 is a reference speed (e.g., 60 km/h). The processor 110 may identify the speed of the adjacent vehicle 200 as 80 km/h, and increase the bounding box by the ratio of the speed of the adjacent vehicle 200 to the reference speed.

That is, the bounding box illustrated in FIG. 6 may be increased by 4/3 when the speed of the adjacent vehicle 200 is km/h. In other words, the processor 110 may increase the width, depth, and height of the bounding box to 4/3w, 4/3d, and 4/3h, respectively.

When the blind spot is determined, the traveling vehicle 100 may detect a second obstacle 400 involved in the blind spot through the laser sensor 170 (S40).

Since the detection method of the second obstacle 400 is the same as that of the first obstacle 300 described above, a detailed description thereof will be omitted.

The processor 110 may detect the second obstacle 400 involved in the blind spot from among the plurality of obstacles detected by the laser sensor 170.

Referring to FIG. 5B again, the processor 110 may identify at least one vehicle around the traveling vehicle 100 through the laser sensor 170. The processor 110 may detect a small vehicle (e.g., the motorcycle) involved in the blind spot of the adjacent vehicle 200 as the second obstacle 400 from among the plurality of identified obstacles.

More specifically, the processor 110 may detect the second obstacle 400, the location coordinates of which are involved in the blind spot, from among one or more obstacles detected by the laser sensor 170.

By way of example, the processor 110 may detect at least one obstacle through the laser sensor 170. Meanwhile, the processor 110 may receive location information from surrounding vehicles, identify the locations of the surrounding vehicles through the laser sensor 170, or identify the locations of the surrounding vehicles through the camera 150. Since the method of identifying the location information through each method is described above, a detailed description thereof will be omitted.

The processor 110 may identify location coordinates involved in the blind spot from among the identified location coordinates of the surrounding vehicles, and detect a vehicle having the corresponding location coordinates as the second obstacle 400.

In another example, the processor 110 may detect the second obstacle 400, the bounding box of which is partially or entirely involved in the blind spot.

Referring to FIG. 6 again, the processor 110 may generate a bounding box of a surrounding vehicle through the laser sensor 170. Since the method of generating the bounding box is described above, a detailed description thereof will be omitted.

The processor 110 may identify a bounding box, in which the area defined by the bounding box (the internal area of the bounding box) is partially or entirely involved in the blind spot, from among the bounding boxes generated for respective surrounding vehicles, and may detect a vehicle corresponding to that bounding box as the second obstacle 400.

When the second obstacle 400 is detected, the traveling vehicle 100 may transmit a danger message to the adjacent vehicle 200 (S50). Here, the danger message may include any alarm message indicating that the obstacle exists in the blind spot. The danger message may be transmitted through the above-mentioned V2V or V2X communication.

The danger message may include various types of information for indicating that the obstacle exists in the blind spot.

The traveling vehicle 100 may transmit a danger message including the location information of the second obstacle 400.

As described above, the processor 110 may identify the location information of the surrounding vehicles, and include the location information of a vehicle detected as the second obstacle 400 from among the surrounding vehicles in the danger message. The communication module 160 may transmit the danger message including the location information of the second obstacle 400 to the adjacent vehicle 200.

In addition, the traveling vehicle 100 may determine the type of the second obstacle 400, and transmit a danger message including the type information of the second obstacle 400.

By way of example, the traveling vehicle 100 may determine the type of the second obstacle 400 by receiving the type information from the second obstacle 400. As described above, the second obstacle 400 may be a vehicle, and the second obstacle 400 may transmit a message to the traveling vehicle 100. Here, the message transmitted by the second obstacle 400 may include its type information. The type information is relevant to characteristics of a vehicle, and may be relevant to any characteristic capable of specifying the vehicle, such as a type, size, and use of the vehicle.

The processor 110 may identify the type information of the second obstacle 400 through the message received from the second obstacle 400, and include the type information received from the second obstacle 400 in the danger message. The communication module 160 may transmit the danger message including the type information of the second obstacle 400 to the adjacent vehicle 200.

In another example, the traveling vehicle 100 may determine the type of the second obstacle 400 through the laser sensor 170. More specifically, the processor 110 may generate a three-dimensional map including the second obstacle 400 based on the laser detected by the laser sensor 170, and may determine the type of the second obstacle 400 based on the image displayed on the generated map.

When the type of the second obstacle 400 is determined, the processor 110 may generate the type information of the second obstacle 400 and include the generated type information in the danger message. The communication module 160 may transmit the danger message including the type information of the second obstacle 400 to the adjacent vehicle 200.

In still another example, the traveling vehicle 100 may determine the type of the second obstacle 400 through the camera 150. More specifically, the processor 110 may analyze the external image captured by the camera 150 to detect the second obstacle 400 as an object and determine the type of the second obstacle 400 based on the size, shape, and form of the object.

When the type of the second obstacle 400 is determined, the processor 110 may generate the type information of the second obstacle 400 and include the generated type information in the danger message. The communication module 160 may transmit the danger message including the type information of the second obstacle 400 to the adjacent vehicle 200.

Accordingly, the adjacent vehicle 200 may determine exactly where the second obstacle 400, which is not currently identified, is located, what the second obstacle 400 is, and how large the size of the second obstacle 400 is, and may travel in consideration of them.

Meanwhile, the traveling vehicle 100 may identify the traveling lane of the second obstacle 400 and transmit a danger message including the traveling lane information of the second obstacle 400.

The processor 110 may identify the traveling lane of the second obstacle 400 by comparing the location information of the second obstacle 400 with the map information stored in the memory 120. More specifically, the processor 110 may identify in which lane the second obstacle 400 is located by comparing the coordinates of each lane included in the map information with the location coordinates of the second obstacle 400.

When the traveling lane of the second obstacle 400 is identified, the processor 110 may generate the traveling lane information of the second obstacle 400 and include the generated traveling lane information in the danger message. The communication module 160 may transmit the danger message including the traveling lane information of the second obstacle 400 to the adjacent vehicle 200.

Accordingly, the adjacent vehicle 200 may determine whether the second obstacle 400, which is not currently identified, is traveling in the same direction or in the opposite direction, and may travel in consideration of it.

The traveling vehicle 100 may transmit the above-mentioned danger message in a broadcast manner. More specifically, the traveling vehicle 100 may transmit the danger message through the V2V or V2X communication in the broadcast manner.

Referring to FIGS. 5B and 8 together, the message A transmitted from the adjacent vehicle 200 may be received by each of the first obstacle 300 and the traveling vehicle 100, the message B transmitted from the first obstacle 300 may be received by each of the adjacent vehicle 200 and the traveling vehicle 100, and the message C transmitted from the traveling vehicle 100 may be received by each of the first obstacle 300 and the adjacent vehicle 200.

Meanwhile, each vehicle may transmit and receive a message based on the protocol used for inter-vehicle communication (e.g., V2V and V2X).

Referring to FIG. 9A, the message A transmitted from the adjacent vehicle 200 may include a message header, vehicle information, sensor information (frame of "Sensor" in FIG. 9A), and object information detected by a sensor (frame of "Object" in FIG. 9A). Here, the vehicle information may include the location information and type information of the above-mentioned vehicle, and the sensor information may include information on the above-mentioned laser sensor 170. The object information may include information on the surrounding vehicle identified by the laser sensor 170.

Referring to FIG. 5B, since the adjacent vehicle 200 may identify only the first obstacle 300 through the laser sensor 170, the message A transmitted from the adjacent vehicle 200 may include the first obstacle 300 may include object information on the first obstacle 300 as illustrated in FIG. 9A.

When the first obstacle 300 is a vehicle, the first obstacle 300 may identify the adjacent vehicle 200, the second obstacle 400, and the traveling vehicle 100 through the laser sensor 170. Therefore, as illustrated in FIG. 9A, the message B transmitted from the adjacent vehicle 200 may include object information on the adjacent vehicle 200, the second obstacle 400, and the traveling vehicle 100.

Since the traveling vehicle 100 may identify the first obstacle 300 and the second obstacle 400 through the laser sensor 170, the message C transmitted from the traveling vehicle 100 may include object information on the first obstacle 300 and the second obstacle 400 as illustrated in FIG. 9A.

Meanwhile, the traveling vehicle 100 may add or insert danger code information to or into the above-mentioned message to generate a danger message and transmit the generated danger message.

As described above, the danger message functions to indicate that the obstacle exists in the blind spot. To this end, the traveling vehicle 100 may generate a danger message by adding or inserting danger code information to or into the existing message.

Referring to FIG. 9A again, the danger code information (frame of "Danger Code" in FIG. 9A) may be added to the rear end of the existing message. The danger code information may include the location information and type information of the above-mentioned second obstacle 400. On the other hand, unlike the illustration of FIG. 9A, the danger code information may also be inserted between frames constituting the existing message.

In addition, the traveling vehicle 100 may generate a danger message by inserting an additional header indicative of the danger code information into the above-mentioned message.

Referring to FIG. 9B, the danger message C transmitted from the traveling vehicle 100 may include not only the above-mentioned danger code information but also the additional header indicative of the danger code information. In this case, the additional header may be inserted immediately after the header included in the existing message.

The additional header may indicate the position of the frame that includes the danger code information, so that the adjacent vehicle 200 receiving the danger message may immediately identify the danger code information by referring to the additional header in processing the danger message.

On the other hand, unlike the above description, the traveling vehicle 100 may transmit a danger message in a geo-networking manner. The geo-networking may refer to a manner of transmitting information to a specific area network.

Accordingly, the traveling vehicle 100 may selectively transmit a danger message only to an adjacent vehicle 200 located in the specific area, from among the plurality of adjacent vehicles 200.

Referring to FIG. 10, the traveling vehicle 100 may set a specific area, to which a danger message will be transmitted, as a destination area, and selectively transmit the danger message to a destination area network.

To this end, contention-based forwarding (CBF) may be used. More specifically, the traveling vehicle 100 may transmit a danger message to a vehicle closest to its location in one direction, and the vehicle receiving the danger message may transmit a danger message to a vehicle closest to its location in one direction again.

In such a manner, the danger message may be transmitted to the destination area, and adjacent vehicles 200*a*, 200*b*, 200*c*, and 200*d* in the destination area may receive the danger message.

The traveling vehicle 100 may transmit a danger message through geographically-scoped anycast (GAC) as one of geo-networking methods. In this case, any adjacent vehicle 200 located in the destination area may receive the danger message.

In addition, the traveling vehicle 100 may transmit a danger message through geographically-scoped unicast (GUC) as one of geo-networking methods. In this case, any adjacent vehicle 200 located in the destination area may receive the danger message.

More specifically, the traveling vehicle 100 may selectively transmit a danger message to adjacent vehicles 200*a* and 200*b* traveling in an opposite lane, from among the plurality of adjacent vehicles 200*a*, 200*b*, 200*c*, and 200*d* located in the destination area, through the GUC. Since the method of identifying the traveling lane of the vehicle is described above, a detailed description thereof will be omitted.

In addition, the traveling vehicle 100 may transmit a danger message through geographically-scoped broadcast (GBC) as one of geo-networking methods. In this case, all adjacent vehicles 200*a*, 200*b*, 200*c*, and 200*d* located in the destination area may receive the danger message.

Besides, the traveling vehicle 100 may follow various communication methods used in the art to selectively transmit a danger message to the destination area.

The adjacent vehicle 200 receiving the danger message transmitted according to the above-mentioned method may output the second obstacle 400 through the vehicle human machine interface (HMI) 140 based on the information included in the danger message.

As illustrated in FIG. 2, the vehicle HMI 140 may be provided in the vehicle. The vehicle HMI 140 may basically function to visually and audibly output the information and state of the vehicle to the driver through a plurality of physical interfaces. To this end, the vehicle HMI 140 may include an audio, video, and navigation (AVN) module 141 and a head up display (HUD) module 142.

The AVN module 141 may include a speaker and a display. The AVN module 141 may audibly output the information and state of the vehicle through the speaker, and may visually output the information and state of the vehicle through the display.

The HUD module 142 may project an image onto a windshield W provided on the front of the vehicle so that the driver may check the projected image while keeping eyes forward.

Referring to FIG. 11, the adjacent vehicle 200 may output the second obstacle 400 to the windshield W through the HUD module 142 based on the danger code information included in the danger message. More specifically, the processor 110 in the adjacent vehicle 200 may control the HUD module 142 to output the silhouette of the second obstacle 400 to the location coordinates of the second obstacle 400 based on the location information of the second obstacle 400 included in the danger code information. The driver of the adjacent vehicle 200 may not only identify the location of the second obstacle 400 through the image projected by the HUD module 142 but also secure a field of view on the front.

In addition, the adjacent vehicle 200 may output a warning image 220 to the traveling lane of the second obstacle 400 based on the information included in the danger message.

More specifically, the processor 110 in the adjacent vehicle 200 may identify the traveling lane of the second obstacle 400 based on the location information of the second obstacle 400 included in the danger code information. Subsequently, the processor 110 may control the HUD module 142 to output the predetermined warning image 220 to the traveling line of the second obstacle 400, as illustrated in FIG. 11.

In addition, the processor 110 may control the AVN module 141 to output the warning image 220 through the display. FIG. 11 illustrates that only the warning image 220 is output to the display of the AVN module 141. However, when a lane is displayed on the display of the AVN module 141, the warning image 220 may be output to the traveling lane of the second obstacle 400.

Besides, the adjacent vehicle 200 may be controlled based on the information included in the danger message. More specifically, the control module 130 in the adjacent vehicle 200 may control the traveling of the adjacent vehicle 200 based on the danger code information included in the danger message.

To this end, the control module 130 may control each in-vehicle drive device (e.g., a power drive device, a steering drive device, a brake drive device, a suspension drive device, a steering wheel drive device, or the like). On the other hand, when the vehicle is an autonomous vehicle, the control module 130 may control each in-vehicle drive device through algorithms for inter-vehicle distance maintenance, lane departure avoidance, lane tracking, traffic light detection, pedestrian detection, structure detection, traffic situation detection, autonomous parking, and the like.

The control module 130 may control the drive device such that the speed of the vehicle does not exceed a reference speed (e.g., 60 km/h) within a predetermined distance from the obstacle, based on the danger code information included in the danger message.

In addition, the control module 130 may control the drive device such that the adjacent vehicle 200 travels along the lane far from the obstacle within a predetermined distance from the obstacle, based on the danger code information included in the danger message.

Besides, the control module 130 may control the drive device through various algorithms considering the location of the obstacle.

Figure 12:
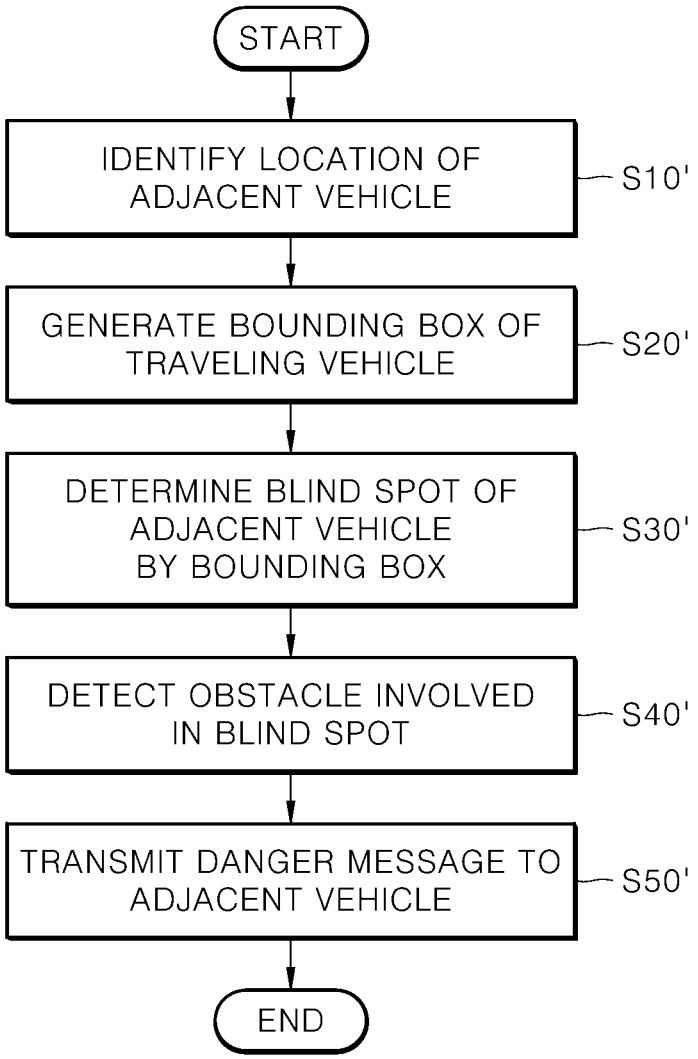
FIG. 12 is a flowchart illustrating an obstacle warning method for a vehicle according to another embodiment of the present invention.

FIG. 12 is a flowchart illustrating an obstacle warning method for a vehicle according to another embodiment of the present invention.

Referring to FIG. 12, the obstacle warning method for a vehicle according to another embodiment of the present invention may include a step of identifying a location of an adjacent vehicle (S10'), a step of generating a bounding box of a traveling vehicle (S20'), a step of determining a blind spot of the adjacent vehicle by the bounding box (S30'), a step of detecting an obstacle involved in the blind spot (S40'), and a step of transmitting a danger message to the adjacent vehicle (S50').

In describing another embodiment of the present invention, reference numeral 300 will be described as a traveling vehicle, and reference numeral 400 will be described as an obstacle. In addition, a description overlapping with the above description will be omitted.

The traveling vehicle 300 may indentify the location of the adjacent vehicle 200 (S10').

More specifically, the traveling vehicle 300 may identify the location of the adjacent vehicle 200 by receiving location information from the adjacent vehicle 200, or may identify the location of the adjacent vehicle 200 through the laser sensor 170. Since the content related to identifying the location of the adjacent vehicle 200 is described above, a detailed description thereof will be omitted.

Next, the traveling vehicle 300 may generate a bounding box of the traveling vehicle 300 (S20'). In other words, the traveling vehicle 300 may generate its bounding box.

Referring to FIG. 6, information on a width w, a depth d, and a height h as the volume information of the traveling vehicle 300 may be pre-stored in the memory 120 in the traveling vehicle 300. Accordingly, the processor 110 may generate the bounding box of the traveling vehicle 300 based on the volume information of the vehicle stored in the memory 120.

Next, the traveling vehicle 300 may determine the blind spot of the adjacent vehicle 200 by the bounding box of the traveling vehicle 300 based on the location of the adjacent vehicle 200 (S30'). Since the method of determining the blind spot by the bounding box is described above with reference to step S30 of FIG. 1 and FIG. 7, a detailed description thereof will be omitted.

Next, the traveling vehicle 300 may detect an obstacle 400 involved in the blind spot through the laser sensor 170 (S40').

Referring to FIG. 6, the traveling vehicle 300 may detect an obstacle 400 (e.g., a motorcycle) in the rear of the blind spot through the laser sensor 170. The method of determining whether the obstacle 400 is within the blind spot may be the same as that described in step S40 of FIG. 1.

When the obstacle 400 is detected in the blind spot, the traveling vehicle 300 may transmit a danger message to the adjacent vehicle 200 (S50'). Since the method of transmitting the danger message is described above with reference to step S50 of FIG. 1 and FIGS. 8 to 10, a detailed description thereof will be omitted.

As described above, in accordance with the present invention, it is possible to warn the adjacent vehicle of one obstacle existing in the blind spot due to another obstacle, or to warn the adjacent vehicle of the obstacle existing in the blind spot due to the traveling vehicle. Therefore, all vehicles on the road can be driven in consideration of the obstacles that are not identified by the sensor, and it is possible to significantly reduce the accident rate due to the sudden emergence of the obstacles.

Meanwhile, the above-mentioned inter-vehicle communication, specifically, the communication between the traveling vehicle 100, the adjacent vehicle 200, and the first and second obstacles 300 and 400 may be performed through a 5G network. In other words, the messages transmitted and received through the inter-vehicle communication may be relayed by the 5G network. For example, when the traveling vehicle 100 transmits any message to the adjacent vehicle 200, the traveling vehicle 100 may transmit the corresponding message to the 5G network, and the 5G network may transmit the received message to the adjacent vehicle 200.

Hereinafter, a process of operating the vehicle for data communication through the 5G network will be described in detail with reference to FIGS. 13 to 17.

Figure 13:
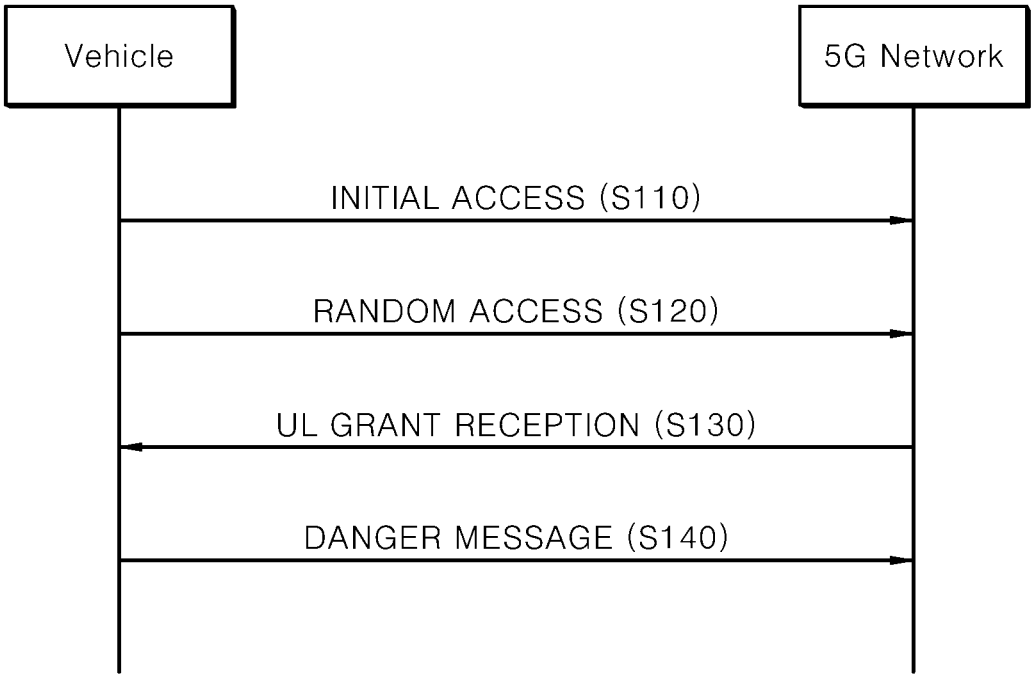
FIG. 13 is a diagram illustrating an example of operation between a vehicle and a 5G network in a 5G communication system.

FIG. 13 is a diagram illustrating an example of operation between the vehicle and the 5G network in the 5G communication system. Hereinafter, the vehicle illustrated in the drawings is described as the above-mentioned traveling vehicle 100. However, the vehicle to be described later may be, of course, any vehicle including the adjacent vehicle 200 and the first and second obstacles 300 and 400.

The traveling vehicle 100 may perform an initial access procedure with the 5G network (S110).

The initial access procedure may include a cell search for downlink (DL) operation acquisition, a process of acquiring system information, and the like.

The traveling vehicle 100 may perform a random access procedure with the 5G network (S120).

The random access procedure may include a preamble transmission for uplink (UL) synchronization acquisition or UL data transmission, a random access response reception process, and the like.

The 5G network may transmit a UL grant for scheduling transmission of the danger message to the traveling vehicle 100 (S130).

The UL grant reception may include a process of receiving time/frequency resource scheduling for transmission of UL data to the 5G network.

The traveling vehicle 100 may transmit the danger message to the 5G network based on the UL grant (S140).

Although not illustrated in FIG. 13, the adjacent vehicle 200 may receive a DL grant through a physical downlink control channel to receive the danger message from the 5G network. In this case, the 5G network may transmit the danger message to the adjacent vehicle 200 based on the DL grant.

FIGS. 14 to 17 are diagrams illustrating an example of the vehicle operation process using the 5G communication.

Figure 14:
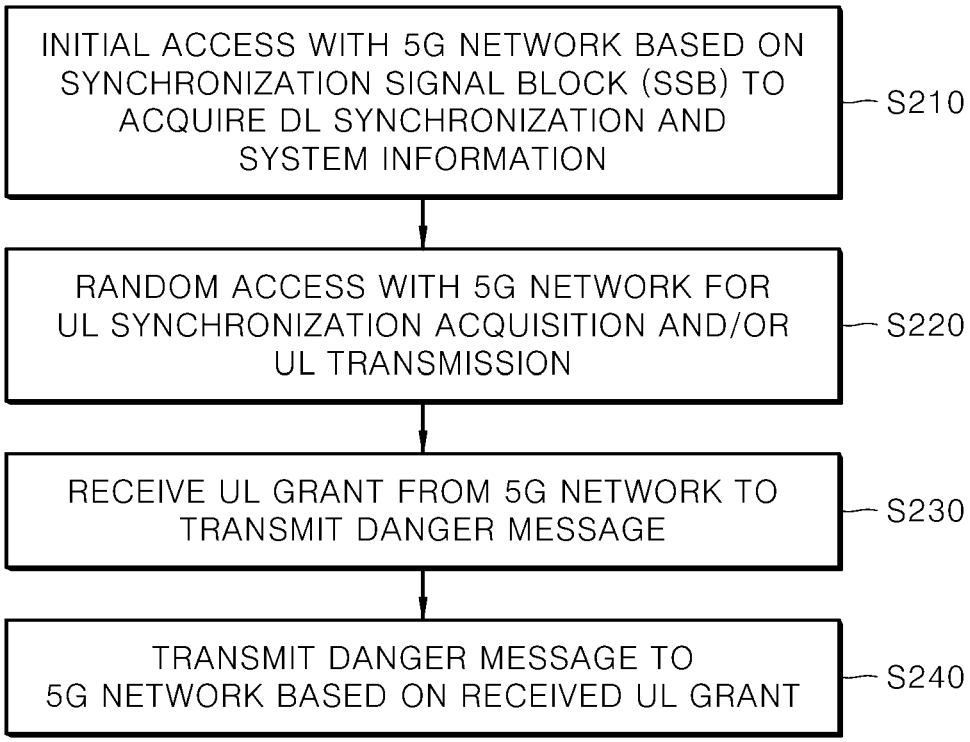
FIGS. 14 to 17 are diagrams illustrating an example of a vehicle operation process using 5G communication.

First, referring to FIG. 14, the traveling vehicle 100 may perform an initial access procedure with the 5G network based on a synchronization signal block (SSB) to acquire DL synchronization and system information (S210).

The traveling vehicle 100 may perform a random access procedure with the 5G network for UL synchronization acquisition and/or UL transmission (S220).

The traveling vehicle 100 may receive a UL grant from the 5G network to transmit a danger message (S230).

The traveling vehicle 100 may transmit the danger message to the 5G network based on the UL grant (S240).

In step S210, a beam management (BM) process may be added. In step S220, a beam failure recovery process related to physical random access channel (PRACH) transmission may be added. In step S230, a QCL relationship may be added in connection with the beam reception direction of the PDCCH including the UL grant. In step S240, a QCL relationship may be added in connection with the beam transmission direction of physical uplink control channel (PUCCH)/physical uplink shared channel (PUSCH) including a danger message.

Meanwhile, although not illustrated in FIG. 14, in order to receive a danger message from the 5G network, the adjacent vehicle 200 may receive a DL grant from the 5G network and may receive a danger message from the 5G network based on the DL grant.

Figure 15:
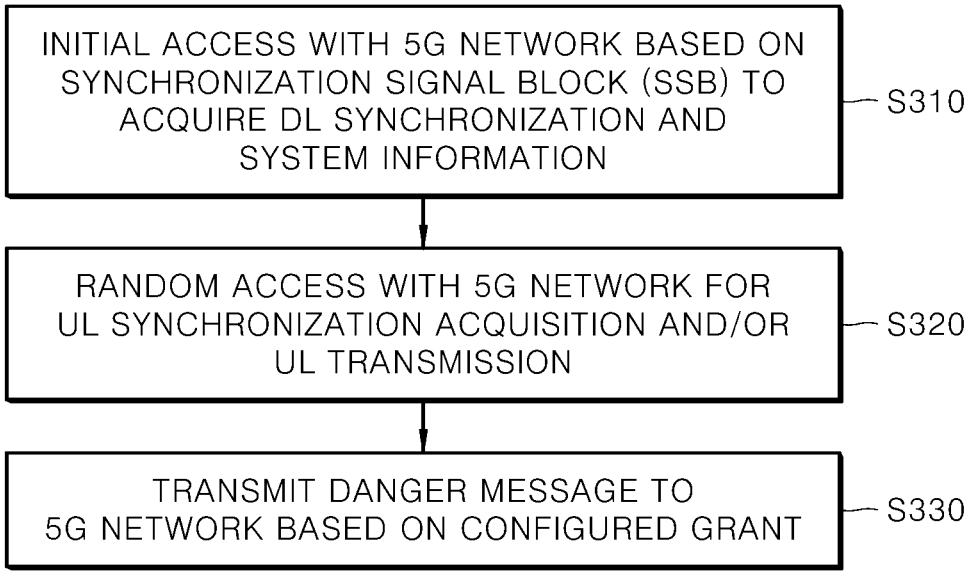

Referring to FIG. 15, the traveling vehicle 100 may perform an initial access procedure with the 5G network based on an SSB to acquire DL synchronization and system information (S310).

The traveling vehicle 100 may perform a random access procedure with the 5G network for UL synchronization acquisition and/or UL transmission (S320).

The traveling vehicle 100 may transmit a danger message to the 5G network based on the configured grant (S330). In other words, instead of the process of receiving the UL grant from the 5G network, the traveling vehicle 100 may also transmit a danger message to the 5G network based on the configured grant.

Meanwhile, although not illustrated in FIG. 15, in order to receive a danger message from the 5G network, the adjacent vehicle 200 may receive a danger message from the 5G network based on the configured grant.

Figure 16:
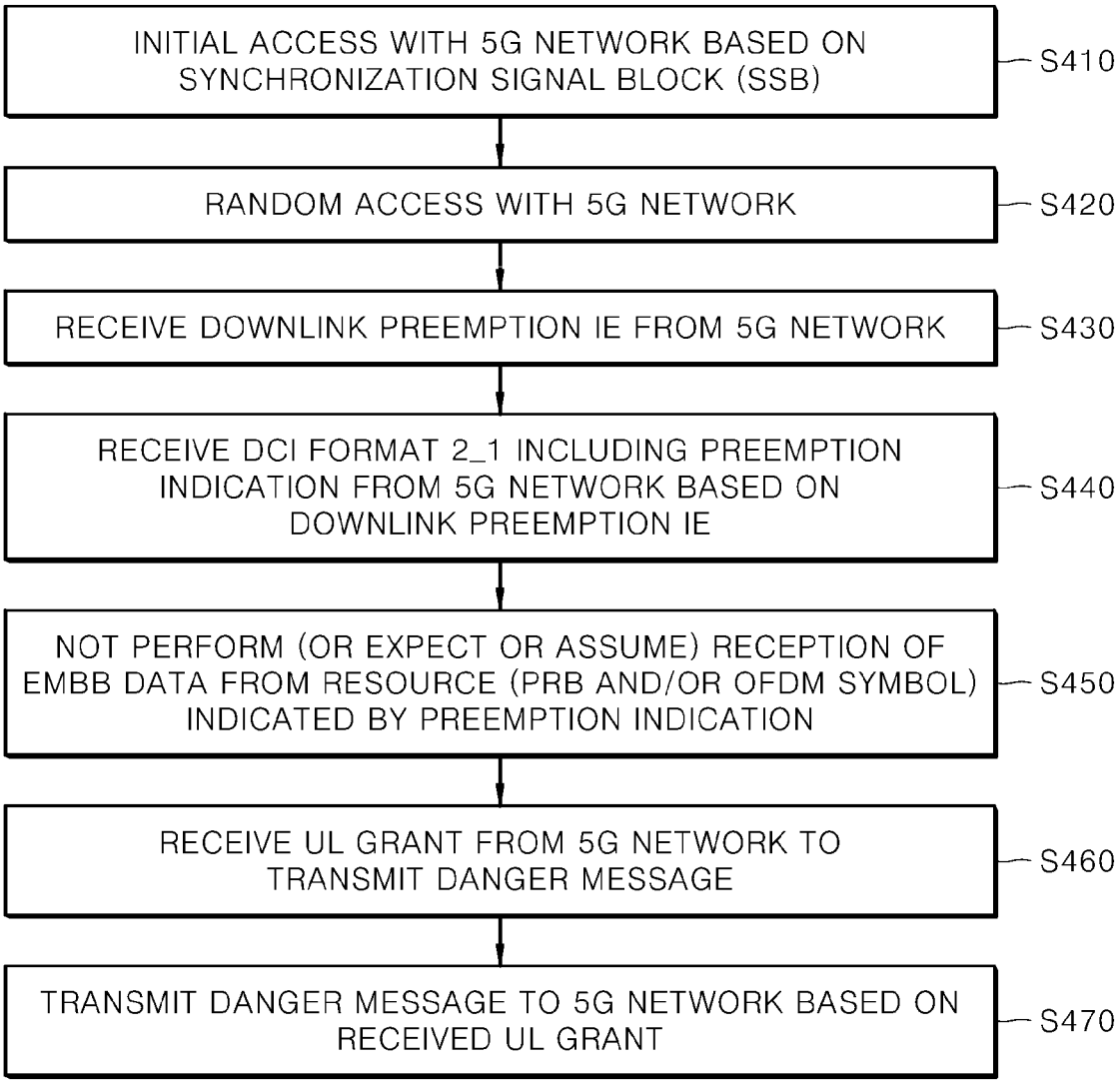

Referring to FIG. 16, the traveling vehicle 100 may perform an initial access procedure with the 5G network based on an SSB to acquire DL synchronization and system information (S410).

The traveling vehicle 100 may perform a random access procedure with the 5G network for UL synchronization acquisition and/or UL transmission (S420).

The traveling vehicle 100 may receive a downlink preemption IE from the 5G network (S430).

The traveling vehicle 100 may receive a DCI format 2_1 including a preemption indication from the 5G network based on the downlink preemption IE (S440).

The traveling vehicle 100 may not perform (or expect or assume) reception of eMBB data from the resource (PRB and/or OFDM symbol) indicated by the preemption indication (S450).

The traveling vehicle 100 may receive a UL grant from the 5G network to transmit a danger message (S460).

The traveling vehicle 100 may transmit the danger message to the 5G network based on the UL grant (S470).

Meanwhile, although not illustrated in FIG. 16, in order to receive a danger message from the 5G network, the adjacent vehicle 200 may receive a DL grant from the 5G network and may receive a danger message from the 5G network based on the DL grant.

Figure 17:
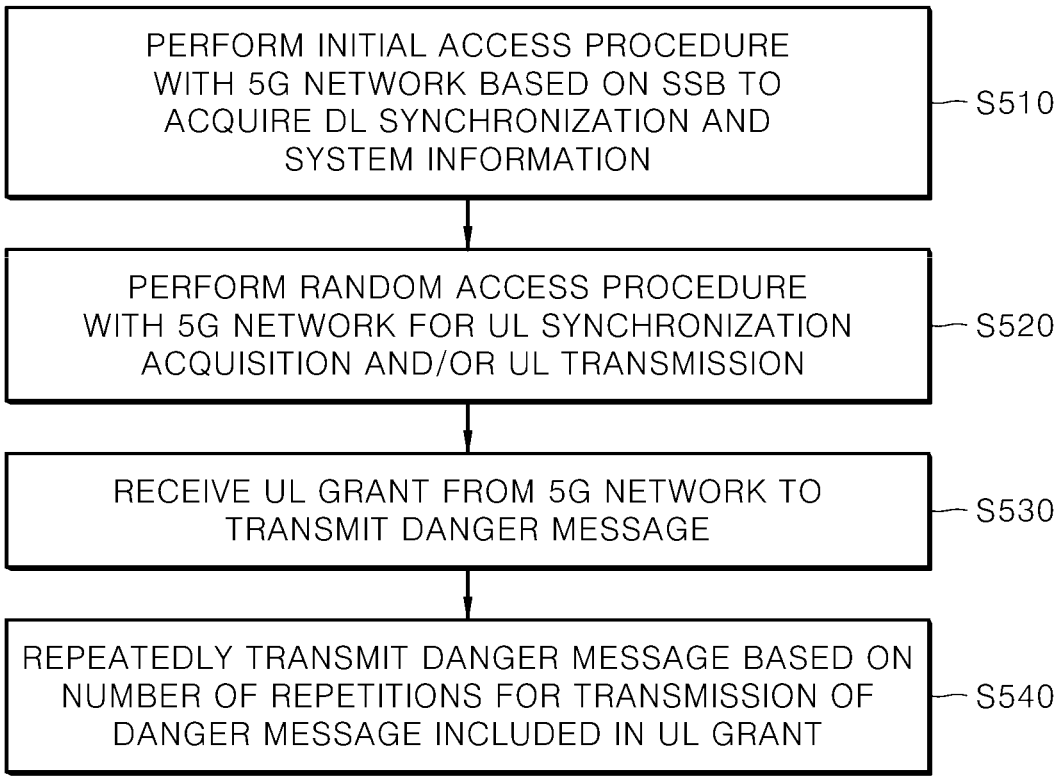

Referring to FIG. 17, the traveling vehicle 100 may perform an initial access procedure with the 5G network based on an SSB to acquire DL synchronization and system information (S510).

The traveling vehicle 100 may perform a random access procedure with the 5G network for UL synchronization acquisition and/or UL transmission (S520).

The traveling vehicle 100 may receive a UL grant from the 5G network to transmit a danger message (S530).

The UL grant may include information on the number of repetitions for the transmission of the danger message, and the danger message may be repeatedly transmitted based on the information on the number of repetitions (S540).

The traveling vehicle 100 may transmit the danger message to the 5G network based on the UL grant.

The repeated transmission of the danger message may be performed through frequency hopping. A first danger message may be transmitted from a first frequency resource, and a second danger message may be transmitted from a second frequency resource.

The danger message may be transmitted through the narrowband of 6 RB (resource block) or 1 RB (resource block).

Meanwhile, although not illustrated in FIG. 17, in order to receive a danger message from the 5G network, the adjacent vehicle 200 may receive a DL grant from the 5G network and may receive a danger message from the 5G network based on the DL grant.

Although the danger message is exemplarily described as being transmitted and received through the data communication between the vehicle and the 5G network in FIGS. 13 to 17, the above-mentioned communication method may be applied to any signal transmitted and received between the 5G network and the vehicle 100.

The 5G communication technology described above may be supplemented to specify or clarify the data communication method of the vehicle described herein. However, the data communication method of the vehicle is not limited thereto, and the vehicle may perform data communication through various methods used in the art.

As apparent from the above description, in accordance with the present invention, it is possible to warn the adjacent vehicle of one obstacle existing in the blind spot due to another obstacle, or to warn the adjacent vehicle of the obstacle existing in the blind spot due to the traveling vehicle. Therefore, all vehicles on the road can be driven in consideration of the obstacles that are not identified by the sensor, and it is possible to significantly reduce the accident rate due to the sudden emergence of the obstacles.

In addition to the effect described above, the specific effects of the present invention have been described together with the above detailed description for carrying out the disclosure.

While various embodiments have been described above, it will be understood to those skilled in the art that the embodiments described are by way of example only and various substitutions, modifications, and changes may be made without departing from the spirit and scope of the invention. Accordingly, the disclosure described herein should not be limited based on the described embodiments.

What is claimed is:

1. A method of a first vehicle for warning a second vehicle of an obstacle, the method comprising:

detecting a first obstacle through a laser sensor;

identifying a location of the second vehicle;

determining a blind spot of the second vehicle at the location of the second vehicle;

detecting a second obstacle in the blind spot of the second vehicle through the laser sensor; and transmitting a danger message to the second vehicle, wherein determining the blind spot of the second vehicle comprises determining the blind spot of the second vehicle based on location coordinates of the second vehicle, and a location and volume of the first obstacle.

2. The method according to claim 1, further comprising:

emitting a laser; and detecting the laser reflected from the first obstacle and the second obstacle based on the emitted laser.

3. The method according to claim 1, wherein identifying the location of the second vehicle comprises receiving location information for the second vehicle.

4. The method according to claim 1, wherein identifying the location of the second vehicle comprises identifying the location of the second vehicle through the laser sensor.

5. The method according to claim 1, wherein determining the blind spot of the second vehicle comprises:

generating a bounding box of the first obstacle; and determining the blind spot of the second vehicle based on the location coordinates of the second vehicle, and corner coordinates of the bounding box.

6. The method according to claim 5, wherein generating the bounding box of the first obstacle comprises adjusting a size of the bounding box according to a speed of the second vehicle.

7. The method according to claim 1, wherein detecting the second obstacle comprises detecting the second obstacle, location coordinates of which are involved in the blind spot, from among one or more obstacles detected by the laser sensor.

8. The method according to claim 1, wherein detecting the second obstacle comprises detecting the second obstacle, a bounding box of which is partially or entirely involved in the blind spot.

9. The method according to claim 1, wherein transmitting the danger message to the second vehicle comprises transmitting the danger message comprising location information of the second obstacle.

10. The method according to claim 1, further comprising:

determining a type of the detected second obstacle; and transmitting a danger message comprising type information of the second obstacle.

11. The method according to claim 1, further comprising:

identifying a traveling lane of the detected second obstacle; and transmitting a danger message comprising traveling lane information of the second obstacle.

12. The method according to claim 1, wherein transmitting the danger message to the second vehicle comprises broadcasting the danger message.

13. The method according to claim 1, wherein transmitting the danger message to the second vehicle comprises transmitting the danger message through a geo-networking.

14. The method according to claim 1, wherein transmitting the danger message to the second vehicle comprises:

generating the danger message by adding or inserting danger code information to or into a message based on a protocol used for inter-vehicle communication; and transmitting the generated danger message to the second vehicle.

15. The method according to claim 14, wherein generating the danger message comprises generating the danger message by inserting an additional header indicative of the danger code information into the message.

16. The method according to claim 1, wherein transmitting the danger message to the second vehicle comprises transmitting the danger message through a $5^{th}$ generation (5G) network.

17. An obstacle warning method for a vehicle, comprising:

identifying a location of an adjacent vehicle;

generating a bounding box of a traveling vehicle;

determining a blind spot of the adjacent vehicle by the bounding box of the traveling vehicle based on the location of the adjacent vehicle;

detecting an obstacle involved in the blind spot through a laser sensor; and transmitting a danger message to the adjacent vehicle.

18. An apparatus of a first vehicle for warning a second vehicle of an obstacle, the apparatus comprising:

a laser sensor;

a transceiver; and a processor operatively connected to the laser and the transceiver, wherein the processor is configured to:

detect a first obstacle through the laser sensor, identify a location of the second vehicle, determine a blind spot of the second vehicle at the location of the second vehicle based on size of the detected first obstacle, detect a second obstacle in the blind spot of the second vehicle through the laser sensor, and transmit a danger message to the second vehicle through the transceiver.

19. The apparatus according to claim 18, wherein the processor is further configured to:

determine the blind spot of the second vehicle based on location coordinates of the second vehicle, and a location and volume of the first obstacle.

20. The apparatus according to claim 19, wherein the processor is further configured to:

generate a bounding box of the first obstacle, and determine the blind spot of the second vehicle based on the location coordinates of the second vehicle, and corner coordinates of the bounding box.

21. The apparatus according to claim 20, wherein the processor is further configured to:

adjust a size of the bounding box according to a speed of the second vehicle.

* * * * *